US006283095B1

(12) United States Patent
Krueger

(10) Patent No.: US 6,283,095 B1
(45) Date of Patent: Sep. 4, 2001

(54) QUICK START FUEL INJECTION APPARATUS AND METHOD

(75) Inventor: William R. Krueger, New Berlin, WI (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/464,188

(22) Filed: Dec. 16, 1999

(51) Int. Cl.[7] ..... F02M 37/08
(52) U.S. Cl. ..... 123/499; 361/154
(58) Field of Search ..... 123/499; 361/154

(56) References Cited

U.S. PATENT DOCUMENTS

| | | | | |
|---|---|---|---|---|
| 4,284,051 | * | 8/1981 | Maisch | 123/499 |
| 4,295,177 | | 10/1981 | Woodhouse et al. | 361/154 |
| 4,300,508 | | 11/1981 | Streit et al. | 123/490 |
| 4,327,695 | * | 5/1982 | Schecter | 123/499 |
| 4,355,620 | * | 10/1982 | Seilly et al. | 123/499 |
| 4,862,866 | | 9/1989 | Calfus | 123/490 |
| 5,267,545 | | 12/1993 | Kitson | 123/490 |
| 5,430,601 | | 7/1995 | Burcham | 361/154 |
| 5,469,828 | * | 11/1995 | Heimberg et al. | 123/499 |
| 5,687,050 | | 11/1997 | Bartsch | 361/154 |
| 5,959,825 | * | 9/1999 | Harcombe | 361/154 |
| 5,992,391 | * | 11/1999 | Yamakado et al. | 123/490 |

OTHER PUBLICATIONS

"Industrial and Computer Peripheral Ics"; Databook; 1hu st Edition; SGS—THOMSON MICROELECRONICS; Oct. 1988; p. 591–597.

* cited by examiner

*Primary Examiner*—Erick Solis
(74) *Attorney, Agent, or Firm*—Fletcher, Yoder & Van Someren

(57) ABSTRACT

A method and apparatus creating a two stage input to an integrated fuel pump of a fuel injector. The fuel pump has a reciprocating assembly for generating a fuel pulse and an actuating coil which induces linear motion of the reciprocating assembly. A nozzle is formed on the distal end of the injector for discharging fuel into a combustion chamber of an internal combustion engine. An energy controller coupled to the fuel pump generates an initial energy phase and a secondary energy phase in the actuating coil. The initial energy phase corresponds to an initial stage of movement of the reciprocating assembly. The initial stage of movement is associated with overcoming internal resistive forces initially present in the reciprocating assembly. The secondary energy phase corresponds to a secondary stage of movement of the reciprocating assembly wherein the initial resistive forces of the reciprocating assembly have been overcome.

19 Claims, 4 Drawing Sheets

QUICK START FUEL INJECTION APPARATUS AND METHOD

BACKGROUND OF THE INVENTION

1. Field of the Invention

The present invention relates generally to an apparatus and method for delivering fuel for combustion in an internal combustion engine. More specifically, the present invention relates to an apparatus and method for supplying and controlling an input parameter to a pulse type fuel injector.

2. Description of the Related Art

An internal combustion engine ignites a mixture of air and combustible fuel within one or more combustion chambers to provide rotational motive force, or torque, to do work. Along with many other factors, proper operation of an internal combustion engine is dependent upon an adequate supply of fuel for combustion. Two measures of engine performance are illustrative of this dependency: engine torque and engine speed. Generally, the torque produced is proportional to the volume of fuel efficiently combusted during a given combustion cycle. The greater the volume of fuel combusted the greater the force produced from the combustion.

For most applications an engine must be able to provide torque at a range of speeds. Engine speed is generally a function of the flow rate of fuel to the combustion chamber. Increasing the speed of the engine shortens the duration of each combustion cycle. Thus, a fuel delivery system must provide the desired volumes of fuel for each combustion cycle at increasingly faster rates if the engine speed is to be increased. Moreover, engine torque and speed can both be limited by the fuel delivery system. Engine torque can be limited by an inability to supply the engine with a sufficient volume of fuel for the combustion cycle. Alternatively, engine speed can be limited by the inability to supply the required volumes of fuel at a desired rate.

In addition to combustible fuel, oxygen is also necessary for combustion. There are various methods of providing fuel and oxygen for combustion to a combustion chamber. The surrounding air, typically, acts as the source of oxygen. An air intake draws in the surrounding air to mix with the fuel. Some delivery systems mix the air and fuel before the two substances are delivered to the combustion chamber. Alternatively, the fuel and air can be delivered separately and mixed within the combustion chamber. Some systems use carburetors to draw fuel vapor into an air stream that is then fed into the combustion chamber. Still other systems use fuel injection to produce fuel vapor from a liquid fuel spray.

There are many current systems and methods of fuel injection. Typically, a programmable logic device controls the operation of the fuel injection system. One or more pumps are used to produce a source of pressurized fuel. A fluid actuator, typically a solenoid operated valve, initiates a flow of pressurized fuel to an injection nozzle. In some applications the fluid actuators produce a surge in fuel pressure. The surge in pressure of the fuel causes the injection nozzle to open, allowing pressurized fuel to flow through the injection nozzle. The shape of the outlet of the injection nozzle contributes to the atomization of the fuel as it exits the injection nozzle. Still other fuel injection systems use an integrated pump and injection nozzle assembly. The pump is electrically operated and controlled to deliver desired volumes of pressurized fuel at desired rates.

Direct fuel injection is a method of fuel injection in which liquid fuel under pressure is injected directly into a cylinder before combustion is initiated in the cylinder by a spark plug. The fuel injection system converts the liquid fuel into an atomized fuel spray. The atomization of the liquid fuel increases the amount of fuel vapor produced. Increasing the amount of fuel vapor is important because it is the ignition of the fuel vapor that produces the combustion in the cylinder. Increasing the pressure of the fuel will also increase the atomization of the fuel when injected into a cylinder.

The available fuel volumes and flow rates for a given fuel delivery system are limited. Typically, the fuel delivery system will be sized to provide adequate fuel volumes and flow rates for the normal expected range of engine operation. However, the fuel delivery system may be increasingly unable to supply the desired fuel volumes at the desired rate at higher engine speeds. Thus, it may arise that the available engine torque and speed may be limited by the ability of the fuel delivery system to supply fuel for combustion. This is particularly the case when fuel delivery systems for one type of engine are applied to higher performance engines, with correspondingly higher fuel volume and flow rate requirements dictated by higher torque, speed and power capabilities.

Another source of limitation in fuel delivery systems is found in the injectors' cycle time. Cycle time refers to the amount of time required for a fuel injector to load with fuel, discharge the fuel into the combustion chamber and then return to its original position to start the cycle over again. Cycle time is typically short for fuel injectors. For example, injectors used in a direct injection system can obtain a cycle time of 0.01 seconds. That equates to the injectors being able to load with fuel, discharge the fuel into the combustion chamber, and then prepare to reload for a subsequent cycle 100 times in a single second. While this cycle time seems very short, it is often desirable to reduce this time even further when possible.

Reduction of cycle time is desirable for several reasons. First, cycle time contributes to a number of engine performance characteristics including low speed torque and high speed power. By reducing the cycle time of the fuel injectors, these two engine performance characteristics can be improved. Second, in certain applications a small window of variability is found to be associated with cycle time. This window of variability is a short period of time which is only a small fraction of the entire cycle time. However, during this short period of time, the variability causes the fuel injectors to discharge either slightly prematurely, or slightly delayed relative to a target discharge time. Having the injector actually discharge at the target discharge time is important for producing efficient power and torque. The target discharge time is determined as a function of various parameters, one of which is the corresponding timing of a spark plug being fired inside the combustion chamber for the ignition of the fuel vapor. If the fuel injection is either premature or delayed, improper combustion will occur resulting in unburned fuel and decreased engine output. The ability to design and produce internal combustion engines having more predictable and controlled performance characteristics is dependent, in part, on being able to address issues such as faster cycle times and reduced injector discharge variability.

SUMMARY OF THE INVENTION

The present invention is directed to overcoming, or at least reducing the affects of, one or more of the problems set forth above. The technique provides a fuel injector having an integral fuel pump. The fuel pump includes a reciprocating assembly for generating a fuel pulse, and an actuating coil which induces linear motion of the reciprocating assembly. A nozzle is formed on the distal end of the injector for discharging fuel into a combustion chamber of an internal combustion engine. An energy controller is coupled to the fuel pump for generating an initial energy phase and a secondary energy phase in the actuating coil. The initial energy phase corresponds to an initial stage of movement of the reciprocating assembly. The initial stage of movement is largely directed towards overcoming internal resistive forces initially present in the reciprocating assembly. The secondary energy phase corresponds to a secondary stage of movement of the reciprocating assembly wherein the initial resistive forces of the reciprocating assembly have been overcome.

The invention also provides a fuel delivery system which includes of plurality of injectors, each having a two phase energy input. Each energy phase corresponds to a stage of movement in a reciprocating pump assembly. The matching of energy input with the movement of the pump assembly allows for a higher degree of efficiency, predictability and control of the fuel delivery system.

The invention further provides a method of controlling a pump type fuel injector. The method includes supplying current at an initial rate to an actuating coil to generate force of a first magnitude within the actuating coil. The force is transmitted to a reciprocating pump resulting in an initial motion of the reciprocating pump. Current is then supplied at a second rate to the actuating coil to generate a second force of a different magnitude within the actuating coil. The second force is also transmitted to the reciprocating pump resulting in a secondary stage of motion of the reciprocating pump. The secondary motion of the reciprocating pump creates a fuel pulse to initiate expulsion of the fuel from within the injector to the combustion chamber of an internal combustion engine.

BRIEF DESCRIPTION OF THE DRAWINGS

The foregoing and other advantages of the invention will become apparent upon reading the following detailed description and upon reference to the drawings in which.

DETAILED DESCRIPTION OF SPECIFIC EMBODIMENTS

Figure 1:
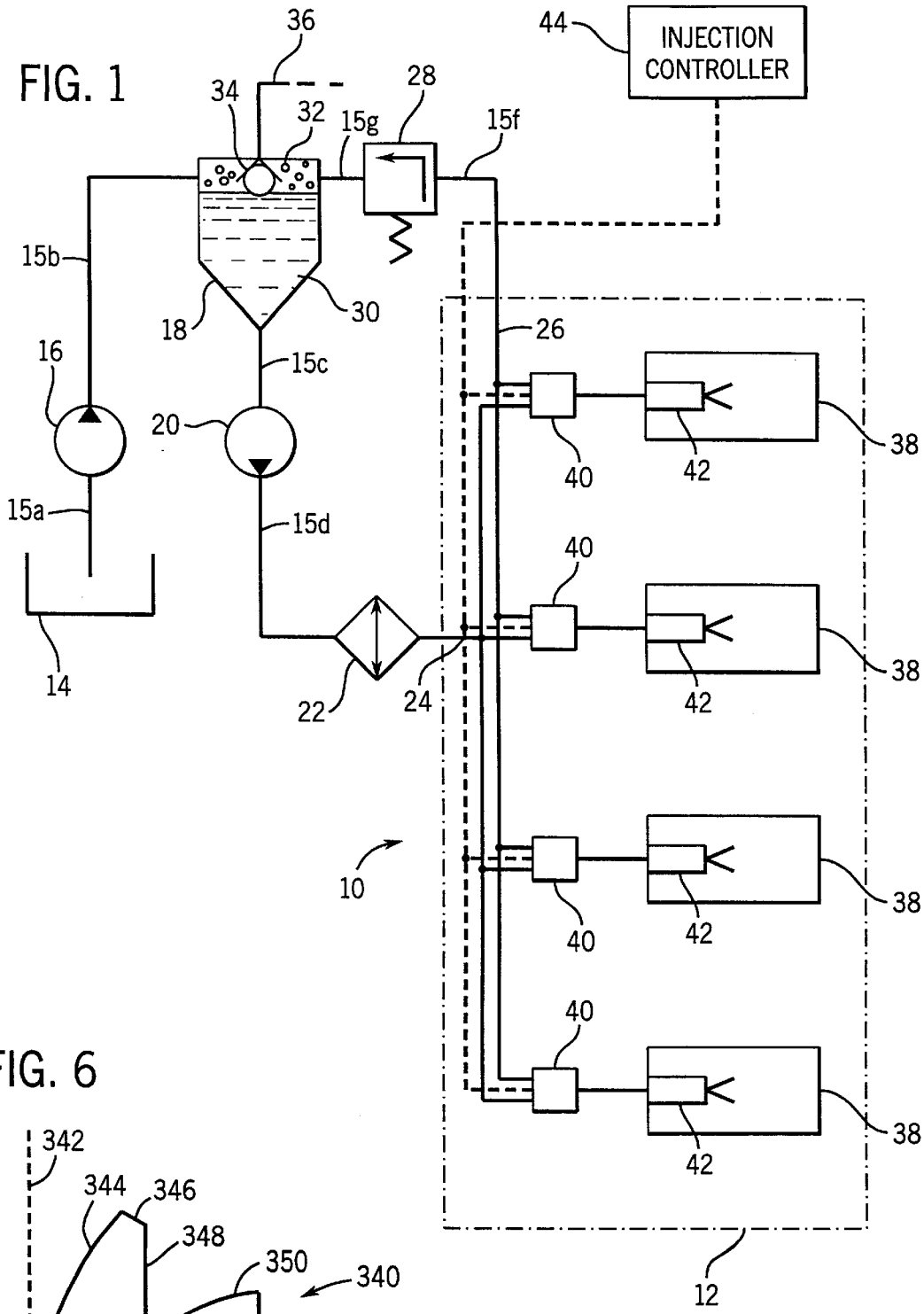
FIG. 1 is a schematic representation of a fuel delivery system utilizing a plurality of fuel delivery assemblies in accordance with certain aspects of the present technique.

Turning now to the drawings and referring first to FIG. 1, a schematic representation is shown of a fuel delivery system 10 for an internal combustion engine 12. In the illustrated embodiment, the fuel delivery system 10 includes, a fuel tank 14, various fuel lines 15, a first fuel pump 16, a gas separation chamber 18, a second fuel pump 20, a fuel filter 22, a fuel supply line 24, a fuel return line 26, a pressure regulator 28, a float valve 34, a ventilation line 36, combustion chambers or cylinders 38, fluid actuators 40 and fuel delivery assemblies, or fuel injectors 42.

Fuel for combustion is stored in the fuel tank 14. A first fuel line 15*a* conveys fuel from the fuel tank 14 to a first fuel pump 16. The first fuel pump 16 draws fuel from the fuel tank 16 and pumps the fuel through a second fuel line 15*b* to a gas separation chamber 18. Fuel flows from the gas separation chamber 18 through a third fuel line 15*c* at or near the bottom of the gas separation chamber. The fuel is coupled to a second fuel pump 20 that pumps fuel through a fourth fuel line 15*d* to a fuel filter 22. Fuel then flows from the fuel filter 22 through a fifth fuel line 15*e* to a common supply line 24 in the internal combustion engine 12. Unused fuel flows from a common return line 26 in the internal combustion engine 12 back to the gas separation chamber 18 through a pressure regulator 28. A sixth fuel line 15*f* couples the common return line 26 to the pressure regulator 28. A seventh fuel line 15*g* couples fuel from the pressure regulator 28 to the gas separation chamber 18.

Fuel that is not used for combustion serves to carry away heat and any fuel vapor bubbles or gases from the fluid actuators 40. Liquid fuel 30 and gas/fuel vapor 32 collects in the gas separation chamber 18. A float valve 34 within the gas separation chamber 18 maintains the desired level of liquid fuel 30 in the gas separation chamber 18. The float valve 34 consists of a float that operates a ventilation valve coupled to a ventilation line 36. The float rides on the liquid fuel 30 in the gas separation chamber 18 and regulates the ventilation valve based upon the liquid fuel level and the presence of vapor in the separator.

Fuel from the common supply line 24 is delivered to a plurality of combustion chambers or cylinders 38 via fluid actuators 40 and fuel delivery assemblies 42. The fluid actuators 40 control the flow of fuel from the common supply line 24 to the fuel delivery assemblies 42. The fluid actuator 40 can accomplish its function in a myriad of ways. The fluid actuator could be a simple solenoid operated valve or could be a pressure surge pump producing pulses of pressurized fuel. An injection controller 44 in turn controls the fluid actuators 40. The injection controller 44 determines the proper fuel flow rate and fuel volume per engine cycle and controls the fluid actuator accordingly to provide the desired amount of fuel.

Figure 2:
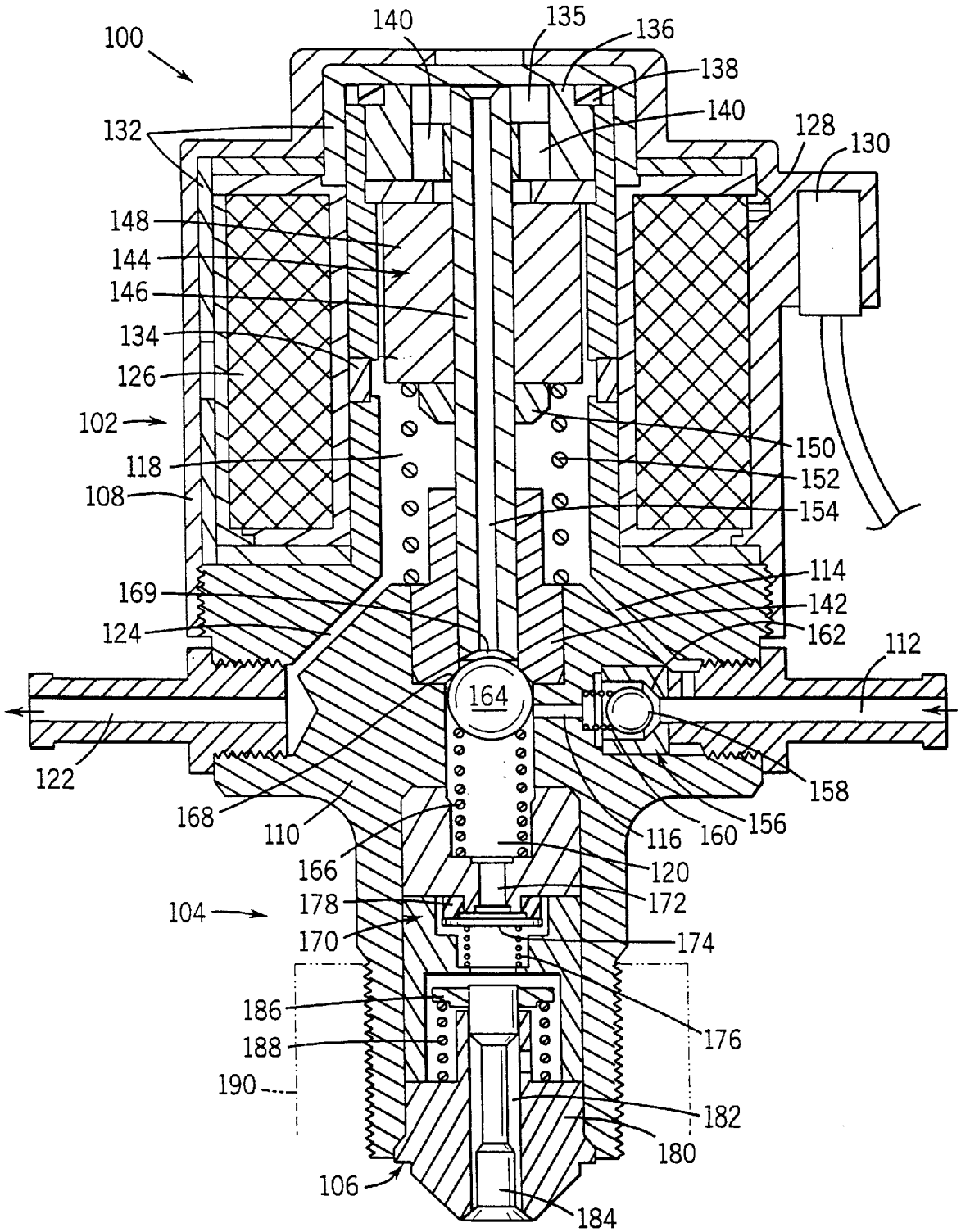
FIG. 2 is a cross-sectional view of a pump-nozzle assembly for use in the system of FIG. 1 at a point during the charging phase of the pump-nozzle assembly in accordance with a preferred embodiment.

Referring to FIG. 2, an embodiment is shown wherein the fluid actuators and fuel injectors are combined into a single unit, or pump-nozzle assembly 100. The pump-nozzle assembly 100 is composed of three primary subassemblies: a drive section 102, a pump section 104, and a nozzle 106. The drive section 102 is contained within a solenoid housing 108. A pump housing 110 serves as the base for the pump-nozzle assembly 100. The pump housing 110 is attached to the solenoid housing 108 at one end and to the nozzle 106 at an opposite end.

There are several flow paths for fuel within pump-nozzle assembly 100. Initially, fuel enters the pump-nozzle assembly 100 through the fuel inlet 112. Fuel can flow from the fuel inlet 112 through two flow passages, a first passageway 114 and a second passageway 116. A portion of fuel flows through the first passageway 114 into an armature chamber 118. For pumping, fuel also flows through the second passageway 116 to a pump chamber 120. Heat and vapor bubbles are carried from the armature cavity 118 by fuel flowing to an outlet 122 through a third fluid passageway 124. Fuel then flows from the outlet 122 to the common return line 26 (see FIG. 1).

The drive section 102 incorporates a linear electric motor. In the illustrated embodiment, the linear electric motor is a reluctance motor. In the present context, reluctance is the opposition of a magnetic circuit to the establishment or flow of a magnetic flux. A magnetic field and circuit are produced in the reluctance motor by electric current flowing through a coil 126. The coil 126 receives power from the injection controller 44 (see FIG. 1). The coil 126 is electrically coupled by leads 128 to a receptacle 130. The receptacle 130 is coupled by conductors (not shown) to the injection controller 44. Magnetic flux flows in a magnetic circuit 132 around the exterior of the coil 126 when the coil is energized. The magnetic circuit 132 is composed of a material with a low reluctance, typically a magnetic material, such as ferromagnetic alloy, or other magnetically conductive materials. A gap in the magnetic circuit 132 is formed by a reluctance gap spacer 134 composed of a material with a relatively higher reluctance than the magnetic circuit 132, such as synthetic plastic.

Once motion begins, a fluid brake within the pump-nozzle assembly 100 acts to slow the upward motion of the moving portions of the drive section 102. The upper portion of the solenoid housing 108 is shaped to form a recessed cavity 135. An upper bushing 136 separates the recessed cavity 135 from the armature chamber 118 and provides support for the moving elements of the drive section at the upper end of travel. A seal 138 is located between the upper bushing 136 and the solenoid housing 108 to ensure that the only flow of fuel from the armature chamber 118 to and from the recessed cavity 135 is through fluid passages 140 in the upper bushing 136. In operation, the moving portions of the drive section 102 will displace fuel from the armature chamber 118 into the recessed cavity 135 during the period of upward motion. The flow of fuel is restricted through the fluid passageways 140, thus, acting as a brake on upward motion. A lower bushing 142 is included to provide support for the moving elements of the drive section at the lower travel limit and to seal the pump section from the drive section.

A reciprocating assembly 144 forms the linear moving elements of the reluctance motor. The reciprocating assembly 144 includes a guide tube 146, an armature 148, a centering element 150 and a spring 152. The guide tube 146 is supported at the upper end of travel by the upper bushing 136 and at the lower end of travel by the lower bushing 142. An armature 148 is attached to the guide tube 146. The armature 148 sits atop abiasing spring 152 that opposes the downward motion of the armature 148 and surge tube 146, and maintains the guide tube and armature in an upwardly biased or retracted position. Centering element 150 keeps the spring 152 and armature 148 in proper centered alignment. The guide tube 146 has a central passageway 154 which permits the flow of a small volume of fuel when the surge tube 146 moves a given distance through the armature chamber 118 as described below. Flow of fuel through the guide tube 146 permits its acceleration in response to energization of the coil during operation.

When the coil 126 is energized, the magnetic flux field produced by the coil 126 seeks the path of least reluctance. The armature 148 and the magnetic circuit 132 are composed of a material of relatively low reluctance. The magnetic flux lines will thus extend around coil 126 and through magnetic circuit 132 until the magnetic gap spacer 134 is reached. The magnetic flux lines will then extend to armature 148 and an electromagnetic force will be produced to drive the armature 148 downward towards alignment with the reluctance gap spacer 134. When the flow of electric current is removed from the coil by the injection controller 44, the magnetic flux will collapse and the force of spring 152 will drive the armature 148 upwardly and away from alignment with the reluctance gap spacer 134. Cycling the electrical control signals provided to the coil 126 produces a reciprocating linear motion of the armature 148 and guide tube 146 by the upward force of the spring 152 and the downward force produced by the magnetic flux field on the armature 148.

The second fuel flow path provides the fuel for pumping and, ultimately, for combustion. The drive section 102 provides the motive force to drive the pump section 104 to produce a surge of pressure that forces fuel through the nozzle 106. As described above, the drive section 102 operates cyclically to produce a reciprocating linear motion in the guide tube 146. During a charging phase of the cycle, fuel is drawn into the pump section 104. Subsequently, during a discharging phase of the cycle, the pump section 104 pressurizes the fuel and discharges the fuel through the nozzle 106, such as directly into a combustion chamber 38 (see FIG. 1).

During the charging phase fuel enters the pump section 104 from the inlet 112 through an inlet check valve assembly 156. The inlet check valve assembly 156 contains a ball 158 biased by a spring 160 toward a seat 162. During the charging phase the pressure of the fuel in the fuel inlet 112 will overcome the spring force and unseat the ball 158. Fuel will flow around the ball 158 and through the second passageway 116 into the pump chamber 120. During the discharging phase the pressurized fuel in the pump chamber 120 will assist the spring 160 in seating the ball 158, preventing any reverse flow through the inlet check valve assembly 156.

A pressure surge is produced in the pump section 104 when the guide tube 146 drives a pump sealing member 164 into the pump chamber 120. The pump sealing member 164 is held in a biased position by a spring 166 against a stop 168. The force of the spring 166 opposes the motion of the pump sealing member 164 into the pump chamber 120. When the coil 126 is energized to drive the armature 148 towards alignment with the reluctance gap spacer 134, the guide tube 146 is driven towards the pump sealing member 164. There is, initially, a gap 169 between the guide tube 146 and the pump sealing member 164. Until the guide tube 146 transits the gap 169 there is essentially no increase in the fuel pressure within the pump chamber 120, and the guide tube and armature are free to gain momentum by flow of fuel through passageway 154. The acceleration of the guide tube 146 as it transits the gap 169 produces the rapid initial surge in fuel pressure once the surge tube 146 contacts the pump sealing member 164, which seals passageway 154 to pressurize the volume of fuel within the pump chamber.

Figure 3:
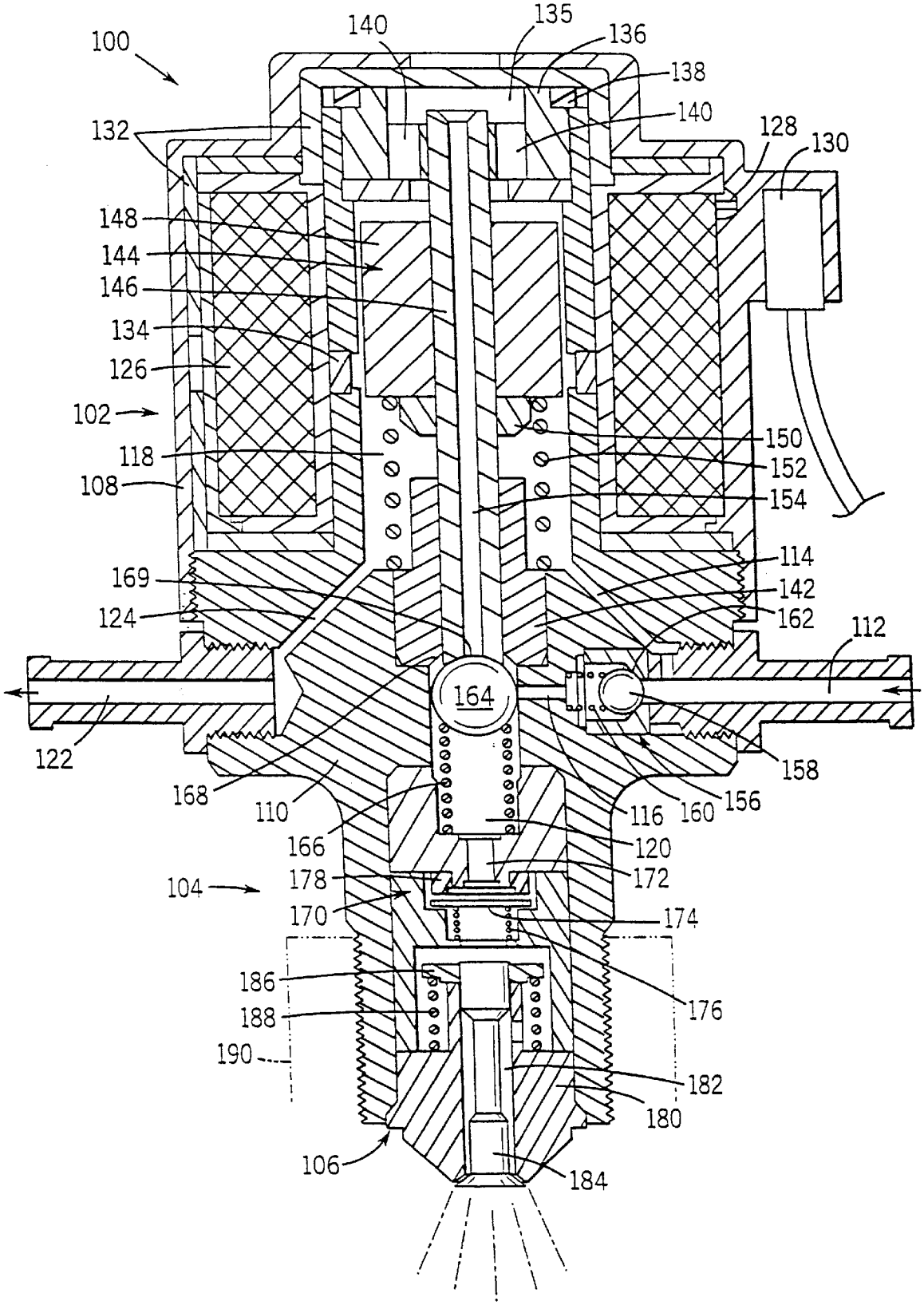
FIG. 3 is a cross-sectional view of a pump-nozzle assembly for use in the system of FIG. 1 at a point during the discharging phase of the pump-nozzle assembly in accordance with a preferred embodiment.

Referring generally to FIG. 3, a seal is formed between the guide tube 146 and the pump sealing member 164 when the guide tube 146 contacts the pump sealing member 164. This seal closes the opening to the central passageway 154 from the pump chamber 120. The electromagnetic force driving the armature and guide tube overcomes the force of springs 152 and 166, and drives the pump sealing member 164 into the pump chamber 120. This extension of the guide tube into the pump chamber causes an increase in fuel pressure in the pump chamber 120 that, in turn, causes the inlet check valve assembly 156 to seat, thus stopping the flow of fuel into the pump chamber 120 and ending the charging phase. The volume of the pump chamber 120 will decrease as the guide tube 146 is driven into the pump chamber 120, further increasing pressure within the pump chamber and forcing displacement of the fuel from the pump chamber 120 to the nozzle 106 through an outlet check valve assembly 170. The fuel displacement will continue as the guide tube 146 is progressively driven into the pump chamber 120.

Pressurized fuel flows from the pump chamber 120 through a passageway 172 to the outlet check valve assembly 170. The outlet check valve assembly 170 includes a valve disc 174, a spring 176 and a seat 178. The spring 176 provides a force to seat the valve disc 174 against the seat 178. Fuel flows through the outlet check valve assembly 170 when the force on the pump chamber side of the disc produced by the rise in pressure within the pump chamber is greater than the force placed on the outlet side of the valve disc 174 by the spring 176 and any residual pressure within the nozzle.

Once the pressure in the pump chamber 120 has risen sufficiently to open the outlet check valve assembly 170, fuel will flow from the pump chamber 120 to the nozzle 106. The nozzle 106 is comprised of a nozzle housing 180, a passage 182, a poppet 184, a retainer 186, and a spring 188. The poppet 184 is disposed within the passage 182. The retainer 186 is attached to the poppet 184, and spring 188 applies an upward force on the retainer 186 that acts to hold the poppet 184 seated against the nozzle housing 180. A volume of fuel is retained within the nozzle 106 when the poppet 184 is seated. The pressurized fuel flowing into the nozzle 106 from the outlet check valve assembly 170 pressurizes this retained volume of fuel. The increase in fuel pressure applies a force that unseats the poppet 184. Fuel flows through the opening created between the nozzle housing 180 and the poppet 184 when the poppet 184 is unseated. The inverted cone shape of the poppet 184 atomizes the fuel flowing from the nozzle in the form of a spray. The pump-nozzle assembly 100 is preferably threaded to allow the pump-nozzle assembly to be screwed into a cylinder head 190. Thus, the fuel spray from the nozzle 106 may be injected directly into a cylinder.

When the control signal or current applied to the coil 126 is removed, the drive section 102 will no longer drive the armature 148 towards alignment with the reluctance gap spacer 134, ending the discharging phase and beginning a subsequent charging phase. The spring 152 will reverse the direction of motion of the armature 148 and guide tube 146 away from the reluctance gap spacer 134. Retraction of the guide tube from the pump chamber 120 causes a drop in the pressure within the pump chamber, allowing the outlet check valve assembly 170 to seat. The poppet 184 similarly retracts and seats, and the spray of fuel into the cylinder is interrupted. Following additional retraction of the guide tube, the inlet check valve assembly 156 will unseat and fuel will flow into the pump chamber 120 from the inlet 112. The operating cycle the pump-nozzle assembly 100 is thus returned to the condition shown in FIG. 2.

Typically, the control signals supplied to the coil 126 by the injection controller 44 will be in the form of short pulses. The injection controller 44 can establish the volume per injection by the duration of the pulse. The flow rate of fuel can be controlled by the duration and frequency of the pulses.

Figure 4:
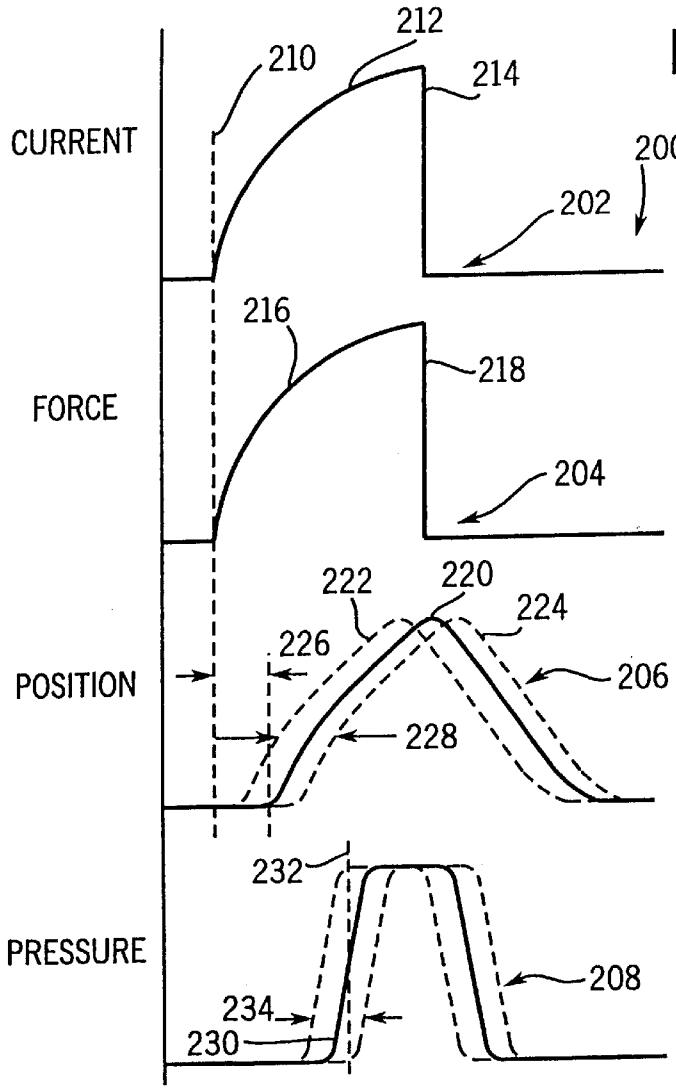
FIG. 4 is a set of plots showing inputs to, and responses of, an exemplary fuel injector.

Referring now to FIGS. 3 and 4, a typical mode of the injector's operation, including the supply of energizing control signals from the injection controller 40, its input waveform and the resulting affects, will now be described. FIG. 4 shows a series of curves and graphs 200. Each curve is plotted in reference to time, with time being represented on the horizontal scale. The first curve is a current curve 202. The current curve shows an input waveform representing the level of electrical current supplied by the injection controller 44 to the coil 126 during the period of time corresponding to one cycle of operation.

The second curve in FIG. 4 represents a force curve 204. The standard force curve represents the amount of force generated within the reciprocating assembly 144 as a result of the applied electrical current. The force curve 204 is generally directly proportional to the current curve 202.

The third curve in FIG. 4 is a position curve 206. The position curve 206 plots the linear motion of the reciprocating assembly 144 based on the force applied to it by the magnetic circuit 132.

The final curve in FIG. 4 is a pressure curve 208. The pressure curve 208 shows the change in fuel pressure in the pump chamber 120. The fuel pressure in the pump chamber 120 is dependent on the position of the sealing member 164, and thus inherently dependent upon the position of the reciprocating assembly 144, as well as the status of the poppet 184 being open or closed. Thus, last three curves 204, 206, and 208 are in large measure a function of the current curve 202.

The current curve 202 shows an input waveform with the input starting at a time of $t_0$, as indicated, the line bearing reference numeral 210. At time $t_0$ the current rises at a rate 212 wherein the slope of the curve, while always positive, decreases in magnitude until the current supply reaches a predetermined level and is finally terminated, as indicated at reference numeral 214. As a result of the input shown in the current curve 202, a proportional force is developed within the reciprocating assembly 144. The force curve 204 shows that at $t_0$ (see line 210) force begins to develop within the reciprocating assembly and increases in a manner which is directly proportional to the amount of current supplied. Similar to the profile of the current curve 202, the force curve 204 reveals a profile showing that the amount of force generated is increasing in magnitude but at an ever decreasing rate 216 until a maximum level is achieved. Corresponding with the termination of current 214 is termination of force applied to drive the reciprocating assembly 144 in the pumping phase of operation.

The linear position of the reciprocating assembly 144, with respect to time, is related to the force applied to the reciprocating assembly 144. However, the position of the reciprocating assembly 144 is affected not only by the force resulting from the energizing control signal, but also by the rate at which the force is generated. Considering the position curve 206, a target curve 220 is shown along with two alternative or potential curves 222 and 224. The target curve 220 represents the desired or predicted position of the reciprocating assembly 144 based on the force curve 204. The target curve 220 indicates a time period, or lag 226, wherein the reciprocating assembly does not move even though force is applied to it. The time lag 226 can be detected by comparing the first indication of movement of the reciprocating assembly 144 on the position curve 206, and the time $t_0$ (line 210) at which force is initially applied, as indicated by force curve 204. The time lag 226 is essentially a result of stiction experienced by the reciprocating assembly 144 within the pump-nozzle assembly 100.

Stiction can generally be referred to as the combination of all the resistive static forces experienced by the reciprocating assembly 144. For example, a certain amount of force is required to overcome the friction found between the guide tube 146 and the upper bushing 136. The friction between these two components acts as a resistive force of a first magnitude before motion of the reciprocating assembly 144 is initiated. After motion of the reciprocating assembly is initiated, the friction between these two components acts as a resistive force having a second, lesser magnitude. The same forces are exhibited between the guide tube 146 and the lower bushing 142. Also, other similar types of resistive forces, such as the resistive forces experienced between the fuel in the armature cavity 118 and the armature 148, or the fuel and the central passage 154 of the guide tube 146. These individual forces combine to provide an initial static force which must be overcome by the reciprocating assembly 144. Ultimately, stiction requires a minimum amount of force to be generated before movement of the reciprocating assembly will be achieved. A time lag 226 is therefore experienced by the reciprocating assembly as represented in the position curve 206. While the time lag 226 may be subject to calculation, accuracy and precision are difficult to obtain in such a calculation because the individual resistive forces are transient and variable. With each individual force being variable, it becomes very difficult to determine the resulting combination of forces with a high degree of certainty.

As described above, the target curve 220 is based on the desired, and predicted motion of the reciprocating assembly 144 in response to the force curve 204. The target curve 220 generally shows that the reciprocating assembly 144 moves in one direction for a short time and then reverses its direction until it comes back to rest. At a point in this movement, the event of injecting fuel through the nozzle housing 180 into a cylinder occurs. The timing of the injection is extremely important to the efficiency and overall performance of an engine. Improper timing of the injection event may generally result in wasted fuel and a noticeable decrease in power.

The injection of fuel is designed to be occur at a precise time before ignition of the fuel by a spark plug. However, because stiction may vary, not only from one pump-nozzle assembly 100 to another, but also from one cycle to another within the same pump-nozzle assembly 100, a range of variance 228 is experienced in the timing of the injection. The range of variance 228 is representative of the fact that stiction may be smaller in magnitude in one cycle, thus producing a premature position curve 222, and greater in magnitude in another cycle, resulting in a delayed position curve 224.

The pressure curve 208 directly follows the position curve 206. The pressure curve 208 shows that, in response to the position of the reciprocating assembly 144, the fuel pressure in the pump chamber 120 increases sharply to a maximum level. As the fuel pressure increases to the maximum level, which is a predetermined design parameter, the fuel begins to discharge through the check valve assembly 170 and the passage 182 of the nozzle housing 182. The fuel continues to discharge for a short time until the reciprocating assembly 144 reverses position reducing the pressure in the pump chamber 120. Because of the direct relationship between the position curve 206 and the pressure curve 208, there is also a range of variance 234 in the timing of the pressure curve. A target pressure curve 230 corresponds with the target position curve 220. Likewise, the positional timing variance 228 directly corresponds to the pressure timing variance 234. Since the check valve assembly 170 and poppet 184 are pressure actuated, the pressure curve correlates directly to the discharge of the fuel through the nozzle.

Figure 5:
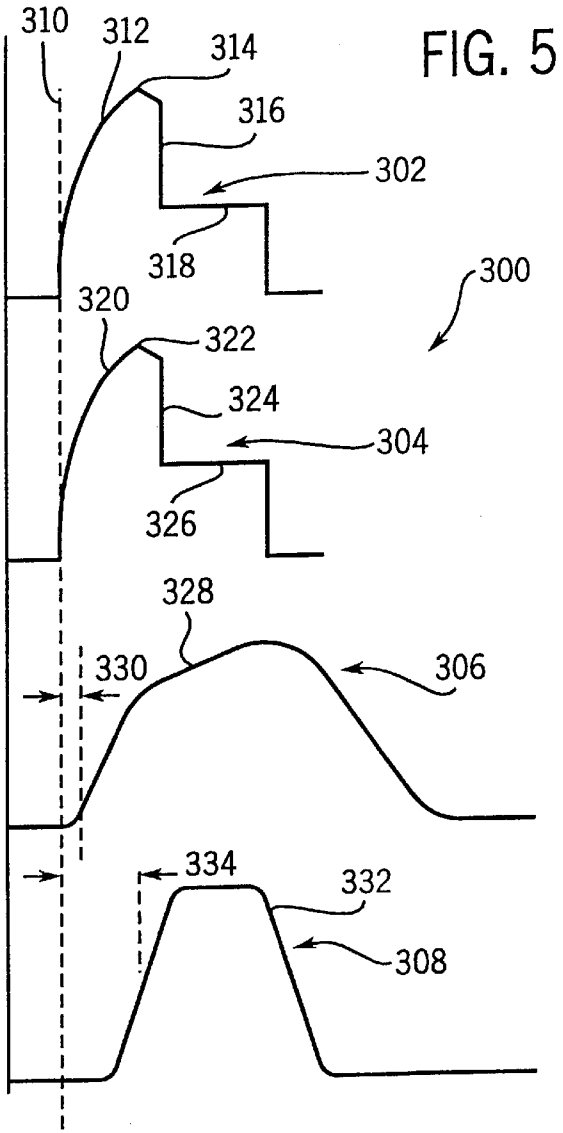
FIG. 5 is a set of plots showing inputs to, and responses of, an exemplary fuel injector according the preferred embodiment.

Referring now to FIGS. 3 and 5, operation of the injector according the presently preferred embodiment of the invention will be discussed. FIG. 5 depicts a second set of curves or graphs 300 based on a modified current input to the coil 126. Each curve is again plotted in reference to time, with time being represented on the horizontal scale. The first curve is a modified current curve 302 showing a modified input waveform supplied by the injector controller 40 for a single cycle of operation. The second curve in FIG. 5 represents a modified force curve 304 representing the amount of force generated within the reciprocating assembly 144. The third curve in FIG. 5 is a modified position curve 306. The modified position curve 306 plots the linear motion of the reciprocating assembly 144 based on the force applied to the armature 148. The final curve in FIG. 5 is a modified pressure curve 208 showing the change in fuel pressure within the pump chamber 120 in response to the positional change of the reciprocating assembly 144.

The modified current curve 302 shows that a current is introduced at a time $t_0$, as indicated by line 310, which increases at an initial rate 312, substantially greater than the rate shown in the original current curve 202. The current reaches a maximum at a rapid pace and then begins to decrease following a peak 314. The short decrease is followed by more rapid reduction 316 of current to a lower, generally constant rate 318. In the illustrated embodiment, the secondary constant rate 318 is maintained for a short time before termination. Thus, a two stage input to the coil 126 is generally defined by the time profile of the energizing control signal. The first stage in this input is the relatively rapid introduction of current into the coil 126, and the second stage comprises a generally constant supply of current at a relatively lower rate.

The modified force curve 304, being generally proportional to the modified current curve 302, exhibits the same characteristics as the modified current curve 302. Starting at time $t_0$ (see line 310) the modified force curve shows a rapid increase 320 in force followed by a peak decrease 322, a reduction 324 to a generally constant level 326, which is ultimately terminated. As a general comparison, the modified current curve 302 and the modified force curve reach a maximum level at much quicker rate than do their respective counterparts in FIG. 4. The result of this rapid input can be seen in the remaining curves of FIG. 5.

The modified position curve 306 shows a slightly different profile than its counterpart in FIG. 4. The most important feature of the modified position curve, however, is the relatively small amount of lag 330 exhibited by the reciprocating assembly 144. The lag 330 is greatly reduced in comparison to the lag 226 exhibited in the standard position curve 206. This reduction is attributed to the increased rate at which the force is applied to the reciprocating assembly 144. While the magnitude of the force may not itself be altered, the rate at which it is applied is substantially increased. This rapid application of force serves to overcome the stiction experienced by the reciprocating assembly 144 much more effectively. In essence, stiction is overcome more quickly because the amount of force required to cause initial movement of the reciprocating assembly 144 has been generated and applied much more quickly.

Another result of rapid generation of force is that the variance in the position curve is minimized or virtually eliminated. Referring back to FIG. 4, a variance 228 in the position curve was produced because of the stiction present in the pump-nozzle assembly 100. However, that variance 228 is based on the combination of all the individual resistive forces resulting in general stiction. By providing a nearly instantaneous force equal in magnitude to the expected upper limit of stiction, the time lag is virtually eliminated and all associated variance is also greatly reduced.

The modified pressure curve 308 shows a single curve 332 which represents the pressure of the fuel in the pump chamber 120. The fuel pressure is now predictable with respect to time as shown in the modified pressure curve 308. This predictability is a function of the modified position curve 306 and is a result of minimizing the time lag 330 along with the associated variance typically experienced on the position curve (i.e., variance 228 in FIG. 4). The modified fuel pressure curve 308 now allows precise and accurate timing of the injection of fuel into the cylinder for ignition.

Another very important result of employing the modified input curve 302 is that cycle time may now be decreased. While the modified curves 300 and the curves 200 are represented as generally having the same time periods, it is not necessary to maintain the similar time periods for each cycle. Instead, since the modified current curve 302 allows for the force to be generated more rapidly, the cycle can theoretically be accomplished in less time. This may include further modification of the input waveform.

Figure 6:
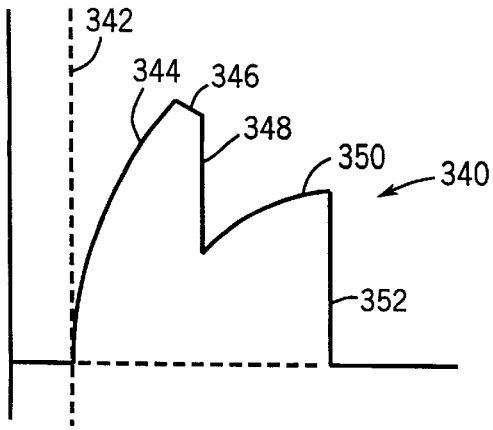
FIG. 6 is a plot of an alternative waveform for an input current to the fuel injector.

By way of example, the second stage of current input showing a constant supply of current 318 may need to be set at a higher rate. In the alternative, it may be desirable to have the second stage of current supplied at an increasing rate, but reaching a lesser magnitude of current than achieved in the first stage of current input. An example of such an input can be seen in FIG. 6. An alternative current curve 340 is shown having a first stage of rapid increase in current supply 344, followed by a small reduction 346 and then a rapid drop 348 in current. A second stage of increasing current 350 then follows and finally ends in termination 352 of the current input. Such a waveform could be utilized to decrease lag time and variance, and to reduce cycle time, each leading to more efficient fuel delivery and improved engine performance. These and other similar variations are contemplated as being within the scope of the invention.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A fuel injection apparatus comprising:

a fuel pump including a reciprocating assembly for generating a fuel pulse, and an actuating coil for inducing motion of the reciprocating assembly;

a nozzle for dissemination of fuel; and an energy controller for generating an initial energy phase and a secondary energy phase in the actuating coil, wherein the initial energy phase corresponds to an initial stage of movement of the reciprocating assembly, and wherein the secondary energy phase corresponds to a secondary stage of movement of the reciprocating assembly.

2. The apparatus of claim 1, wherein the initial energy phase has a higher energy state than the secondary energy phase.

3. The apparatus of claim 2, wherein the fuel pulse is generated after the initial energy phase of the energy controller.

4. The apparatus of claim 2, wherein the fuel pulse is generated during the secondary energy phase of the energy controller.

5. The apparatus of claim 2, further comprising a pressure chamber, wherein the reciprocating assembly is in communication with the pressure chamber, and wherein the pressure chamber is in communication with an inlet of the nozzle.

6. The apparatus of claim 5, wherein the fuel pulse is generated within the pressure chamber.

7. The apparatus of claim 6, wherein the nozzle is pressure activated responsive to the fuel pulse.

8. A fuel delivery system for internal combustion engines comprising:

a plurality of fuel injectors, each injector comprising a fuel pump which comprises a reciprocating assembly for generating a fuel pulse, and an actuating coil for inducing motion of the reciprocating assembly, a pressure chamber in communication with the reciprocating assembly, and a nozzle having an inlet, the inlet being in communication with the pressure chamber;

a plurality of combustion chambers, each combustion chamber being in communication with the outlet nozzle of at least one of the plurality of fuel injectors;

an energy controller having a repeatable cycle which comprises generating an initial energy phase and a secondary energy phase in the actuating coil of each of the plurality of injectors, wherein the initial energy phase induces initial movement of the reciprocating assembly and the secondary energy phase induces further movement of the reciprocating assembly; and a sequencing controller for determining the order of activation of each actuating coil by the energy controller.

9. The fuel delivery system of claim 8, wherein the sequencing controller activates each actuating coil sequentially.

10. A method of controlling a pump injector comprising:

(a) supplying current at an initial rate to an actuating coil;

(b) generating a first force within the actuating coil;

(c) applying the first force to a reciprocating pump;

(d) inducing an initial motion of the reciprocating pump;

(e) supplying current at a secondary rate to the actuating coil;

(f) generating a second force within the actuating coil;

(g) applying the second force of the reciprocating pump;

(h) inducing a secondary motion of the reciprocating pump, wherein the secondary motion of the reciprocating pump creates a fuel pulse to initiate expulsion of the fuel from within the injector, and (i) returning the reciprocating pump to an initial position.

11. The method of claim 10, wherein the initial motion of the reciprocating pump comprises a movement of the reciprocating pump to overcome opposing internal static forces of the reciprocating pump.

12. The method of claim 11, wherein the secondary motion of the reciprocating pump comprises a constant velocity of the reciprocating movement.

13. The method of claim 11, wherein the secondary motion of the reciprocating pump comprises an increasing velocity of the reciprocating movement.

14. The method of claim 11, wherein the secondary motion of the reciprocating pump comprises a decreasing velocity of the reciprocating movement.

15. The method of claim 10, wherein the expulsion of fuel from the injector comprises the step of delivering fuel to a combustion chamber of an internal combustion engine.

16. An internal combustion engine, comprising:

a combustion chamber;

a fuel delivery system for injecting fuel into the combustion chamber, the fuel delivery system comprising:

a fuel pump having a coil for inducing motion of a member within the pump to produce a surge in fuel pressure; and a controller for providing a current pulse to the coil, the current pulse having a first portion and a second portion, wherein the first portion is adapted to overcome resistive forces opposing motion of the member and induce initial movement of the member, further wherein the second portion is adapted to continue the movement of the member initiated by the first portion.

17. The engine as recited in claim 16, wherein the resistive forces comprise friction forces opposing motion of the member.

18. The engine as recited in claim 16, wherein the member comprises a tube.

19. The engine as recited in claim 16, wherein the fuel pump comprises a reluctance motor having a movable armature coupled to the member, the coil inducing motion of the member by inducing motion of the armature.

* * * * *